United States Patent [19]

Parlante

[11] Patent Number: 4,874,118

[45] Date of Patent: Oct. 17, 1989

[54] PISTOL HOLSTER WITH LIMITING SWING CLUTCH

[76] Inventor: John K. Parlante, 998 Sheldon Ave., Staten Island, N.Y. 10309

[21] Appl. No.: 864,261

[22] Filed: May 19, 1986

[51] Int. Cl.[4] ..... F41C 33/02

[52] U.S. Cl. ..... 224/198; 16/386; 16/374; 16/363; 403/157; 403/113

[58] Field of Search ..... 224/197–200; 16/386, 374, 363; 403/157, 113

[56] References Cited

U.S. PATENT DOCUMENTS

| | | | |
|---|---|---|---|
| 3,117,708 | 1/1964 | Goldman | 224/197 |
| 3,168,972 | 2/1965 | Parlante et al. | 224/197 |
| 3,261,519 | 7/1966 | Horne | 224/197 |
| 3,915,361 | 10/1975 | Perkins | 224/198 |
| 4,079,870 | 3/1978 | Clark | 224/198 |
| 4,478,532 | 10/1984 | Puro | 403/157 |

*Primary Examiner*—Henry J. Recla

*Attorney, Agent, or Firm*—William T. Hough

[57] ABSTRACT

A pistol holster with a limiting swing clutch having the holster and belt-loop separated from one-another by the engaged swing clutch face-to-face elements, all held in a tightly compressed state susceptible of limited flexing movement against a flexible leather washer, all mounted on a female bolt's female-threaded shaft between under-face flat surfaces of the heads of the female bolt and the mated male bolt.

10 Claims, 1 Drawing Sheet

PISTOL HOLSTER WITH LIMITING SWING CLUTCH

BACKGROUND TO THE INVENTION

Prior to the present invention, the inventor has been in business many years in the promotion and sale of swing-type holsters of the type to which the present invention is directed, and under such circumstances has become aware of poor durability of bolts or other fasteners on which the pivoting pistol holster is mounted. More particularly, a common practice heretofore has been to utilize brads to fasten a washer onto a shaft of the braded bolt, with the result that over reasonable extended use in the wearing and/or pivoting of the holster mounting the pistol therein, the brad has become compressed and/or bent and/or sheared to an extent that required pressure for optimal suspension and pivoting of the holster has been significantly lost or destroyed. A reason for having gone the use of a braded bolt, was that nuts mounted on a male-threaded bolt promptly becomes loose as a result of excessive pressure on the nut causing the nut to loosen and/or causing the meshed male and female threads to be deformed or stripped thereby rendering the combination defective in its support and operation.

When the pistol holster is worn on a belt around the waist of a person, the thigh and/or leg pressures against an inward side of the holster serves to cause continual shifting of and causing of excessive lateral pressures against the holster, and likewise against the adjacently mounted belt-loop member. Such pressures and destructive forces are characterized by such pistol holster use, as contrasted to other joined elements in some other art where pivoting of adjacent members is to be found. That is to say, that these problems arise specifically and particularly as associated with at least primarily pistol holster art for the pivoting holster. The problem of required high compression is even greater where as with the present invention there is associated a limiting swing clutch mechanism requiring a significantly high degree of compression in order for the face-to-face engaged swing clutch elements to function properly. As a result of the elevated compression pressures required, the lateral destructive pressures that the mounting elements are subjected to during the wearing and use of the belt-mounted pivital swing-type holster serve to bend, strip and/or shear the heads and/or washer and/or nuts and/or threads thereof. Because police departments and the like that constitute a significant percentage of the customers and purchasers of such pistol holster, require an optimally high level of durability and quality in the products upon which perhaps the life of a police officer could depend, it has become critically necessary for the present inventor to develope a new improved device meeting these required criteria.

Problems and difficulties of the type and nature discussed above have been incountered by the pistol holster disclosed in U.S. Pat. No. 3,168,972 patented Feb. 9, 1965 to H. Parlante et al..

OBJECTS OF THE INVENTION

Accordingly, one or more objects of the present invention are to overcome and/or avoid problems and/or difficulties of the types discussed above.

More particularly, an object of the present invention is to obtain a swing holster fastener optimally useful with a limiting swing clutch mechanism, that is sustainable of compressive pressures imparted by the mounting and compressing fastener around which the pistol holster and belt loop are pivotally revolvable.

Another object is to obtain such holster fastener as a part of a combination with the holster and belt loop member mounted on the holster fastener, while achieving the aforestated objects.

Another object is to obtain resilience and/or flexibility for the belt loop member and/or the holster mounted on the fastener above-noted, to an extent that required optimal compressive pressures are retained while damage from excessive destructive pressures are averted and/or avoided.

Other objects become apparent from the preceding and following disclosure.

One or more objects of the invention are achieved by the invention as set forth herein, and as exemplified by the typical and/or disclosed embodiments.

SUMMARY OF THE INVENTION

Broadly the invention may be characterized as a swivel joint fastener having improved durability while being sustainable of compression on parts pivotally rotatably mounted on a shaft of the fastener between opposing heads thereof, of the type described hereafter. The invention more particularly represents critical improvements on the pistol holster combination illustrated in the above-noted Parlante et al. United States patent 3,168,972.

In one embodiment of the present invention, there is provided a fastener combination of a male-threaded bolt critically having a substantially flat under-face surface thereby adapted to exert and sustain compressing force, and a mateable female-threaded bolt likewise cricially having an opposing (spaced opposite thereto in opposing relationshipe) substantially flat under-face surface likewise adapted to exert and sustain compressing force, whereby the pivotally rotatably mounted members comressed elements adjacently mounted between the under-face surfaces are compressible tightly together. This is particularly as required for preferred embodiments such as pivotally mounted pistol holster and belt loop holster support structure. Also, such elevated compressive pressure being even more critical for proper operation when the mounted elements on the fastener include the limiting swing clutch engaged opposing elements which do not properly function when in mere loose association and/or contact. Another critical element in this embodiment is the presence of a hardened thread-lock type composition such as a hardened epoxy resin or other locking or fusing material/-composition applied to the male and/or female threads prior to the hardening thereof and preferably prior to the mating thereof in the state of mounting the holster, the belt-loop structure, the limiting swing clutch elements, and/or other mounted elements.

Another embodiment is the combination of such a fastener having the pistol holster and belt loop structure mounted thereon, with the hardening composition in a hardened state locking the male and female threads to thereby avoid loosening thereof and/or the stripping thereof when opposing heads of the male-threaded and female-threaded bolts are subjected to excessive lateral pressures of the types discussed in the background discussion.

Preferably the locking and/or hardening-type composition is an epoxy resin which when properly cured by admixing a hardening or curing component thereof thereafter hardens into a locking state. However, in this embodiment, any desired and/or conventional and/or commercially available thread-binding or thread-locking composition may be utilized.

Another broad embodiment of the present invention utilizes a male-threaded bolt of the type defined above, in combination with a female-threaded bolt also of the type defined above, in further combination with a flexible washer mounted or mountable on the shaft of the female-threaded bolt; the flexible washer when mounted is adjacent and pressed against an under-face surface of the head of one of the male-threaded and female-threaded bolt. Preferably the flexible washer is pressed against the under-face surface of the head of the female-threaded bolt, but alternatively may be pressed against the under-face surface of the head of the male-threaded bolt.

In a more preferred combination, the flexible washer is of leather. However, other flexible washers may be of any desired or conventional commercially-avaialable composition(s), such as plastic and/or fiberglass and/or matted fabric or the like.

In a further preferred embodiment, there is included with the fastener the plurality of separate members adapted to pivotally rotate on the shaft of the female-threaded shaft, more preferably such separate members being the pistol holster and the belt-loop support structure discussed-above.

In a further embodiment, there is included with the fastener additionally the above-disclosed hardenable composition for locking or fusing the threads of the male-threaded and female-threaded bolts when mated, appliable preferably immediately prior to the final mating of the male-threaded and female-threaded bolts when mated after mounting elements thereon to be secured. In a more preferred combination thereof, there is included the plurality of separate members adapted to pivotally rotate on the shaft of the female-threaded shaft, more preferably such separate members being the pistol holster and the belt-loop support structure discussed-above, with the locking composition in place and hardened and/or locking the bolts together.

The above-noted flexible waher makes possible a flexing of the separate members toward and away from each other while avoiding excessive shearing pressures on the heads of the mated bolts during such flexing.

The locking (hardened/hardenable) composition above-discussed avoids distorting meshed male and female threads whereby compressing pressure on the separate members is retainable by preventing a loosening of the female-threaded shaft from the male-threaded shaft.

By virtue of the invention of the above-noted embodiments, it is possible to utilize higher compressive pressures on the elements compressed between the opposing under-face surfaces of the heads of the mated male-threaded and female-threaded bolts, and/or to improve functional pivotal operation and/or durability of the entire combination over prolonged periods of use.

By virtue of the high pressure of compression made possible by the present invention, between the opposing bolts' heads above-noted, the limiting swing clutch elements are held in face-to-face operational and functional contact firmly engaged, enhancing and facilitating the pivoting and the limiting of the number of degrees of pivoting-rotation.

The invention may be better understood by making reference to the drawings of the following Figures.

THE FIGURES

Figure 3:
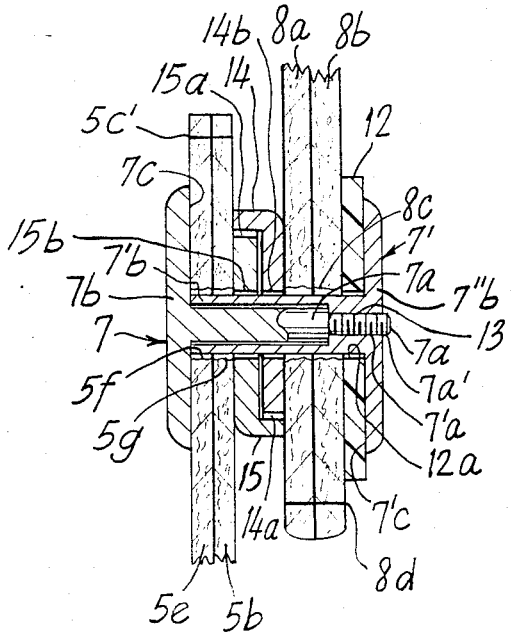

FIG. 3 illustrates a side in-part view in partial cross-section of a preferred embodiment of the invention inclusive of the fastening device having the epoxy resin hardened and locking the male and female threads of the mated bolts, and the flexible washer and pistol holster and belt- loop structure and engaged limiting-swing elements all mounted on the shaft of the female-threaded bolt and all compressed between the flat under-face surfaces of the heads of the mated male-threaded and female-threaded bolts.

DETAILED DESCRIPTION

To the extent that the same elements are illustrated in different Figures, element(s) once described will not be redundantly repeated, except in certain instances for purposes of clarity, noting that all Figures illustrate a common same embodiment, in differing views and illustrations thereof.

Figure 1:
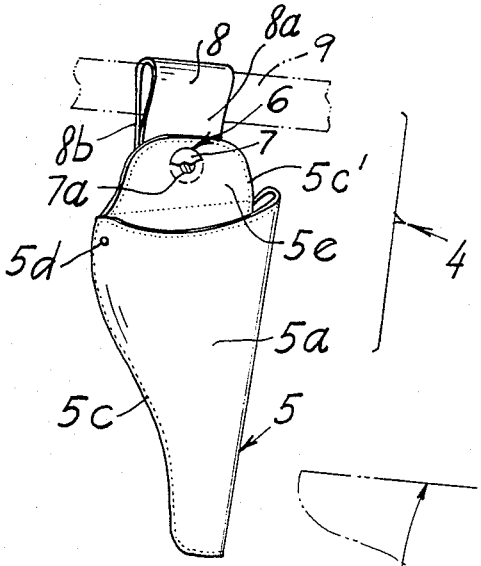
FIG. 1 illustrates in elevation plan view, a view of the outer-side of a preferred embodiment of a pistol holster and belt-loop structure mounted pivotally on the fastener.
Figure 2:
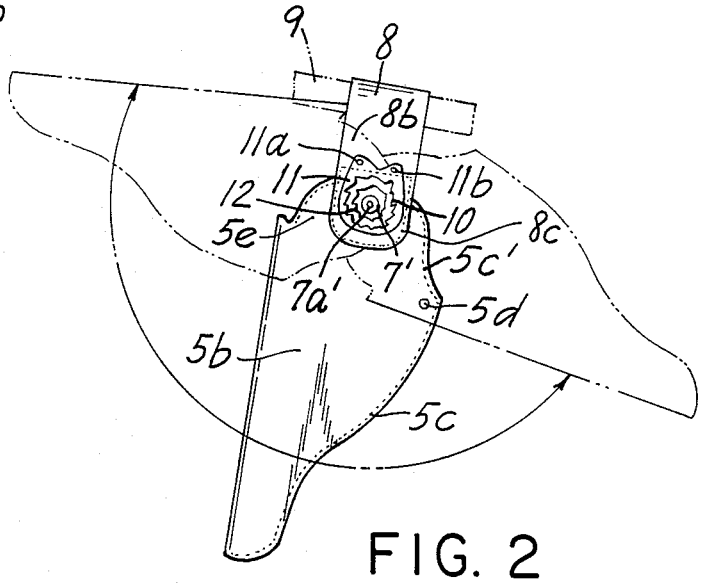
FIG. 2 illustrates in partial phantom and still in elevation plan view, the inner-side of pistol holster and belt-loop structure of FIG. 1, illustrating typically the degrees of permissible pivotal rotation, and also in cut-away of an optional flap, the female-threaded bolt's head and the flexible washer mounted adjacent to that head.

In all Figures, there is shown the embodiment 4 of the combination inclusive of both the flexible washer 7' (see FIGS. 2 and 3, not shown in FIG. 1) and the hardened composition 13 (see FIG. 3, not shown in FIGS. 1 or 2), in which the pivotally rotatable elements are the pistol holster 5, the belt-loop structure 8, and the swing-limiting elements 14 and 15 (see FIG. 3, not shown in FIGS. 1 or 2).

With reference to FIG. 1, there is shown an outward-exposed (when mounted on and suspended from a belt) view of the pistol holster, showing outer-side 5*a* of holster 5. Unnumbered arrows indicate directions of allowable rotational pivot around the fastening device (combination) 6. The fastening combination 6 of embodiment 4 includes (for this embodiment) the male-threaded bolt 7, the female-threaded bolt 7', the hardened composition 13, and the flexible washer 12; the female-threaded bolt 7', the hardened composition 13 and the flexible washer 12 are not shown in Figure 1. There is shown the holster stitching 5*c* and 5*c'* and the holster upper mounting-portion 5*e*, and a brad 5*d*. Also there is shown the male-threaded bolt's head 7, and with partial cut-away also shown (in cross-section) the male shaft 7*a*, and also there is shown the outer portion 8a and inward portion 8*b* of the belt-loop structure 8, and in phantom view there is shown a typical belt or strap 9.

In FIG. 2, as viewed through an imaginary cut-away 10 of flap 11, there is shown the flexible washer 12, and also shown are brads 11*a* and 11*b*. Other elements shown in this Figure have been already discussed.

FIG. 3, the more revealing and detailed Figure, additionally better shows the positional locations and arrangements of elements already discussed above, together with other elements as follow. The male threads 7*a'* of the male-threaded shaft 7*a* of male-threaded bolt 7 are mated with the female threads 7'*a* of the female-threaded shaft 7'*b* of head 7'*b* fused (locked) by hardened composition 13, with the female-threaded shaft 7'*a* extending through the flexible washer 12 and through the holes 8*c* of the belt-loop leather strips 8*a* and 8*b*, and through the holes 5*f* and 5*g* of holster reenforced upper leather portions 5*b* and 5*e*, and through the intermediately located swing limiting elements 14 and 15 having through-space holes 14*b* and 15*b* and having pivot-limiting faces 14*a* and 15*a*. It is noted that the swing-limiting device here shown to be composed of swing limiting elements 14 and 15 are identical in shape and operation to those shown and illustrated in the above-noted U.S. Pat. No. 3,168,972. However, any desired or conventional other swing-limiting device may be utilized, the invention not being in the particular type of limiting device except to the extent that such device requires or preferably has compressive pressure as a part of its assembly with the holster, for example. Prior to the hardening of the hardened composition 13, the male-threaded and female-threaded bolts 7 and 7' are tightened sufficiently to tightly compress the holster reenforced upper leather strips 5*b* and 5*e* and the belt-loop leather strips 8*a* and 8*b* and the swing limiting elements 14 and 15, and the flexible washer 12, such that all thereof are held firmly and tightly pressed together before, during and after pivotal rotating of the holster on the female-threaded shaft 7'*b*. The under-face surface 7*c* of the head 7*b* of the male-threaded bolt 7 is pressed firmly and securely against the side face (as shown) of the upper leather portion 5*e*, while the under-face surface 7'*c* is pressed firmly and securely against the side face (as shown) of the flexible washer 12. The illustraed belt-loop leather strips 8*a* and 8*b* are sewn together by the stitching 8*d*.

It is within the scope of the present invention to make variations and substitution of equivalents, to the extent that such are within ordinary skill of the art.

I claim:

1. A swivel joint fastner device comprising in combination a first element having a first head having a substantially flat first under-face and having a male-threaded shaft and male threads thereof extending from said first head's said first under-face surface, a second element having a second head with a substantially flat second under-face surface and having a female-threaded shaft and female threads thereof extending from said second under-face surface, a flexible washer mounted in juxtaposition to said second underface surface and around said female-threaded shaft, a plurality of separate members each pivotably mounted on said female-threaded shaft and compressed between said first under-surface and said flexible washer such that each of said separate members is oppositely rotatable around said female-threaded shaft relative to a remaining other one of the separate members and such that each of the separate members is flexible toward and away from a remaining other one of the separate members, and a swivel-limiting means for limiting number of degrees of rotation of one of said separate members relative to a remaining one of said separate members, mounted on said female-threaded shaft in a compressed state of being compressed tightly between adjacent revolvable elements each having a substantially flat face compressed flushly against the flat face of the other, and each having flange means limiting the extent of each revolvable member's revolving movement around said female-threaded shaft relative to the other revolvable member, said compressed state being of sufficiently high compression to maintain said flat faces in a compressed operative state, and said flexible washer flexibly yielding sufficiently to permit said separate members of the swivel-limiting means to revolve one relative to the other while concurrently avoiding excessive pressure on said male and female shafts and heads thereof, said excessive pressure being pressure sufficiently high for one of said male threads and of said female threads to shear-off a remaining one of said male threads and of said female threads with a resulting shearing-off of the head of one or more of the first and second elements when exerted against at-least one of the first and second heads, thereby making possible a flexing of the separate members toward and away from each other and thereby avoiding said excessive shearing pressures on said first and second heads of said first and second elements during such flexing.

2. A swivel joint fastener device of claim 1, including a locking hardened composition securely fastening said male-threaded shaft within said female-threaded shaft such that flexing of said separate members when mounted on said female-threaded shaft avoids distorting meshed male and female threads whereby compressing pressure on the separate members is retainable by preventing a loosening of the female-threaded shaft from the male-threaded shaft.

3. A swivel joint fastener device of claim 2, in which said composition includes a major and predominant amount of an epoxy resin in a hardened state.

4. A swivel joint device of claim 2, in which one of said separate members is a pistol holster and in which a remaining one of said separate members is a support means for mounting onto a person.

5. A swivel joint device of claim 4, in which said support means is a loop element adapted for mounting on a belt or strap.

6. A swivel joint device of claim 5, in which said composition includes a major and predominant amount of an epoxy resin in a hardened state.

7. A swivel joint device of claim 1, in which said separate members are each a flexible composition.

8. A swivel joint device of claim 7, in which at-least one of said separate members is leather.

9. A swivel joint device of claim 7, in which at least one of said separate members is plastic.

10. A swivel joint device of claim 1, in which said flexible washer has an outside diameter greater than an outside diameter of said second under-face surface of said second head.

* * * * *